United States Patent [19]

Lofquist et al.

[11] Patent Number: 4,771,978

[45] Date of Patent: Sep. 20, 1988

[54] ARTICULATED VERTICAL SUPPORT STAND

[76] Inventors: Marven J. Lofquist, 15850 Pleasant Valley La., Salinas, Calif. 93908; John W. Isaac, 1056 Carmelita Dr., Salinas, Calif. 93901

[21] Appl. No.: 102,532

[22] Filed: Sep. 28, 1987

[51] Int. Cl.[4] ..... F16M 13/00

[52] U.S. Cl. ..... 248/526; 248/528

[58] Field of Search ..... 248/526, 523, 524, 525, 248/528, 158, 188.7

[56] References Cited

U.S. PATENT DOCUMENTS

| | | | |
|---|---|---|---|
| 183,100 | 10/1876 | Albrecht | 248/524 X |
| 357,792 | 2/1887 | Smith | 248/526 X |
| 830,671 | 9/1906 | Neff | 248/523 |
| 883,235 | 3/1908 | Rauch | 248/526 |
| 1,524,061 | 1/1925 | Tennant | 248/526 X |
| 1,721,980 | 7/1929 | Wardell | 248/526 X |
| 1,898,300 | 2/1933 | Gustafson et al. | 248/526 X |
| 2,028,129 | 1/1936 | Allerton | 248/526 X |
| 2,242,270 | 5/1941 | Sims | 248/524 X |
| 2,455,025 | 11/1948 | Schroeder | 248/526 X |
| 2,879,019 | 3/1959 | Fox | 248/523 |

FOREIGN PATENT DOCUMENTS

| | | | |
|---|---|---|---|
| 639915 | 9/1936 | Fed. Rep. of Germany | 248/525 |

*Primary Examiner*—J. Franklin Foss

*Attorney, Agent, or Firm*—Schroeder, Davis & Orliss Inc.

[57] ABSTRACT

An articulated vertical support stand having an articulated base plate for holding and supporting cut trees or staffs having an irregularly shaped, curved or twisted trunk in a substantially vertical, upright position. A horizontally oriented base plate having a central opening is supported by three support members pivotally and removably attached to the base plate at points equidistantly spaced about the periphery of the base plate forming joints allowing articulation therebetween. The support members having sharpened spikes protruding from their upper ends for engaging and gripping the lower portion of the trunk when the lower portion of the trunk is inserted through the opening. The base plate includes a plurality of cam means pivotally attached to its lower surface for engaging the lower portion of the trunk protruding through the opening.

11 Claims, 2 Drawing Sheets

ARTICULATED VERTICAL SUPPORT STAND

BACKGROUND OF THE INVENTION

The present invention relates generally to portable stands for supporting Christmas trees, staffs and the like having an irregularly shaped lower portion in an upright position, and more particularly to a Christmas tree stand having an articulated base plate to accommodate supporting cut trees or staffs having irregularly shaped, twisted or curved trunks.

Christmas tree stands and holders are well known in the art and many types are generally available. The following U.S. patents are representative of the large number of existing patents on Christmas tree stands: U.S. Pat. Nos. 830,671; 1,549,959; 1,590,214; 1,721,980; 2,455,025 and 3,454,246.

The primary object of the present invention is to provide a Christmas tree stand adaptable for supporting in an upright position trees having twisted and curved trunks.

A further object of the present invention is to provide a Christmas tree stand adaptable for supporting various sizes of trees or staffs.

A further object of the present invention is to provide a Christmas tree stand which is inexpensive to manufacture and one which is simple in construction and operation.

SUMMARY OF THE INVENTION

A Christmas tree stand constructed in accordance with the principles of the present invention comprises a flat base plate having a plurality of outwardly and downwardly extending support legs pivotally and removably attached at points spaced equidistant around the periphery of the base plate forming joints allowing articulation therebetween and having a centrally disposed opening therethrough for receiving the lower end of a tree trunk of staff. The upper ends of the legs are slightly curved and have a number of sharpened spikes protruding from the curved surface. The sharpened spikes projecting into the tree trunk to provide effective, though limited, attachment to the trunk of a tree during use of the stand. A plurality of cam means are pivotally attached about the periphery of the opening on the lower side of the base plate. During use of the stand the lower end of a tree trunk is inserted through the opening in the base plate, the upward ends of the support legs are pivoted inwardly to engage the tree trunk at a position spaced upwardly from the terminal lower end thereof and the cam means are rotated to protrude inwardly and engage the portion of the tree trunk protruding below the base plate through the opening, whereby the trunk is engaged at two vertically spaced locations to effect adequate bracing of the tree against tilting or falling. The lower portion of the tree trunk or staff may extend through the base plate opening into contact with the surface upon which the stand rests to provide a third support point for the tree or staff.

Since the support legs are pivotally attached to the base plate, if the lower trunk is irregularly shaped, badly curved or twisted for example, the articulatable base plate will tilt allowing the upper ends of the support legs to engage the tree trunk at varying heights and angles above the base plate while the cam means hold and maintain the portion of the trunk protruding through the base plate in the opening thereby supporting the tree or staff in a rigid, upright position.

DETAILED DESCRIPTION OF THE PREFERRED EMBODIMENT

Figure 1:
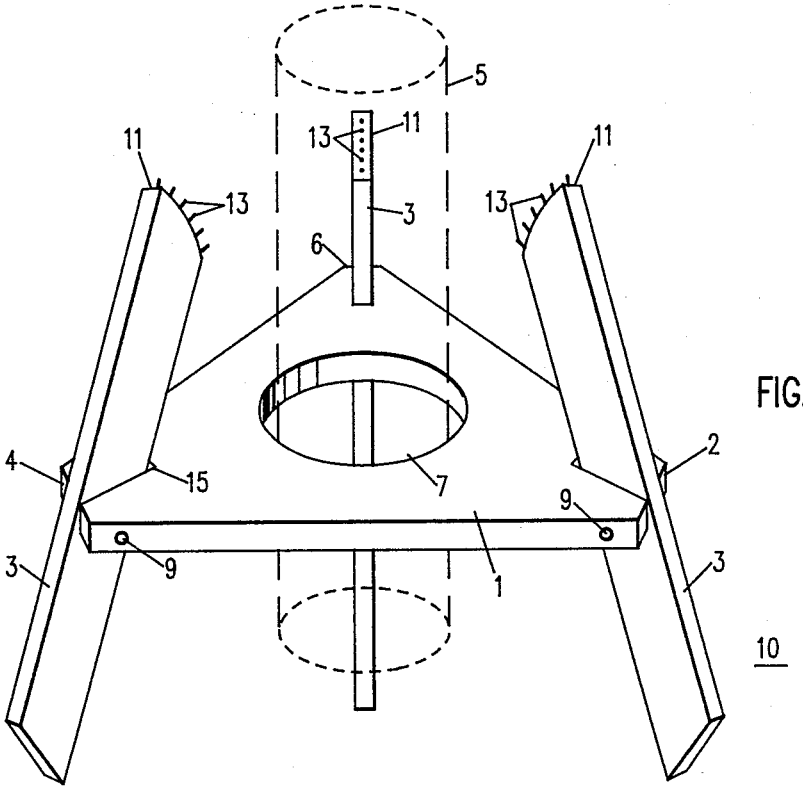
FIG. 1 is a perspective view of a Christmas tree stand constructed according to the principles of the present invention.
Figure 2:
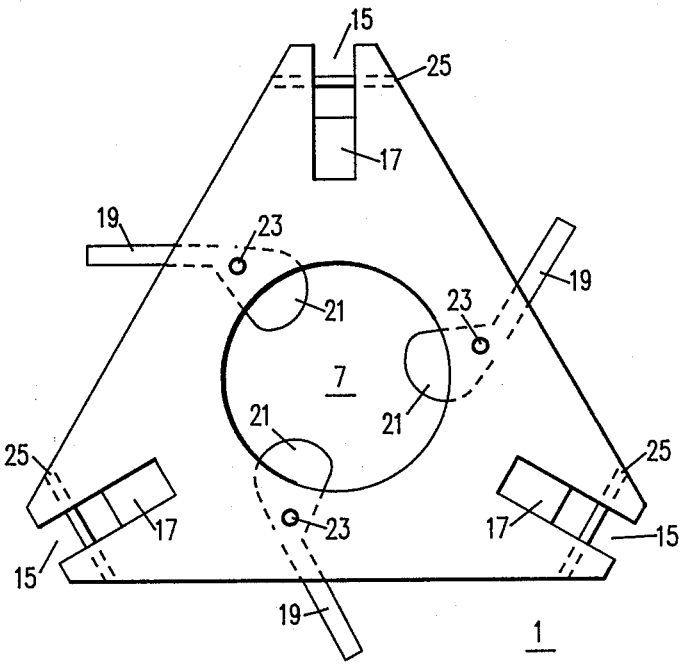
FIG. 2 is a top view of the base plate and cam levers of the Christmas tree stand illustrated in FIG. 1.

Referring now to FIGS. 1 and 2, a Christmas tree stand constructed in accordance with the principles of the present invention is shown. The Christmas tree stand 10 comprises a horizontally oriented triangular-shaped base plate 1 having elongated support legs 3 pivotally attached at the base plate 1 corners 2, 4 and 6. Each of the support legs 3 is secured in the slot or bifurcation 15 at each corner 2, 4, 6 of the base plate 1 by pivot pin 9 inserted through aperture 25 and a hole (not shown) through the support leg 3. The support legs 3 may be rotated about pivot pin 9 such that the lower portion of the support legs 3 extend downwardly and outwardly from the base plate 1 while the upper portion extends upwardly and inwardly towards the center of the base plate 1. The base plate 1 has a large, circular opening extending through the base plate 1 for receiving the lower portion of a tree trunk or staff 5 (indicated by dashed lines). The diameter of opening 7 is sufficiently large to support trees or staffs of the desired size.

The upper ends 11 of the support legs 3 are curved slightly and have a number of sharpened spikes 13 protruding outwardly from the curved surface. When the support legs 3 are pivoted about pivot pins 9, the upper portions of the support legs 3 pivot inwardly and engage tree trunk 5 and sharpened spikes 13 bite or dig into the tree trunk 5 to brace and maintain the tree in an upright position. Once the sharpened spikes 13 have engaged the tree trunk 5, downward movement of the tree trunk 5 will cause the spikes 13 to further bite into the trunk. The greater the weight of the tree tending to force the trunk downward, the tighter and more securely the trunk 5 is held. The support legs 3 may be of any desired length; but it is advantageaous to have the support legs 3 be of sufficient length to provide stability to the stand 10 when it is in use. The inward end of each slot 15 has an upward sloping wall 17 to prevent the support legs 3 from pivoting past a predetermined angle and reducing the stability and strength of the stand when in use.

Cams 21 are pivotally attached to the lower surface of base plate 1 equidistant about the peripheral of opening 7 with pivot pins 23. Each cam 21 has a cam lever 19 for rotating the cams 21 about pivot pins 23 causing cams 21 to protrude into the opening 7 and progressively engage the surface of tree trunk or staff 5 at evenly circumferentially spaced locations and thereby firmly grip the lower terminal end of trunk 5. The engaging surfaces of cams 21 may be ridged or serrated to provide greater frictional engagement with the surface of trunk 5.

While the base plate 1 is shown to be triangularly shaped, the base plate 1 may be of any desired shape such as circular, the only requirement being that the support legs 3 are disposed equidistant about the perimeter of the base plate 1 and the opening 7 be substantially centered in the base plate. Three support legs have been described, but any number greater than three may be utilized if desired. However, in practice it is found that three support legs are generally sufficient. The base plate 1 and support legs 3 are preferable fabricated from wood, but may be of any suitable material such as plastic or metal.

Figure 3:
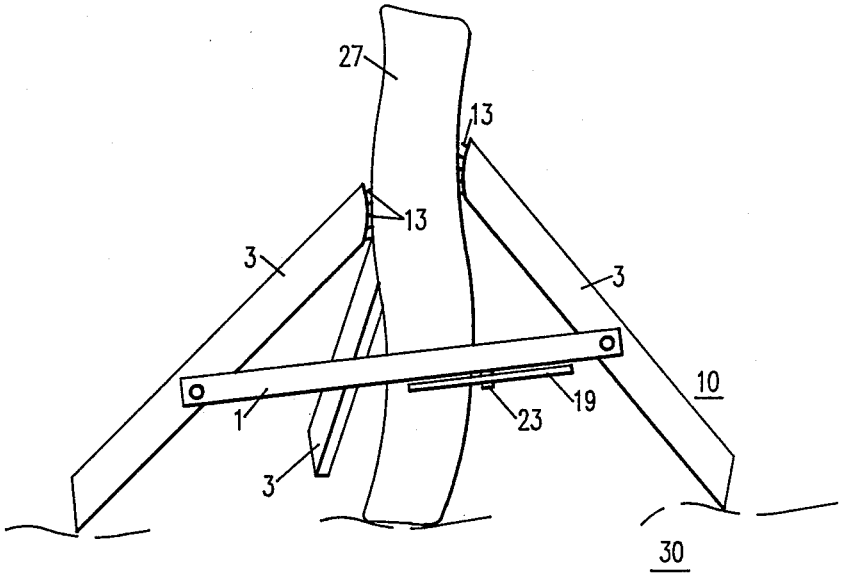
FIG. 3 is a perspective view of the Christmas tree stand supporting a curved portion of a tree trunk.

Referring now also to FIG. 3, curved tree trunk or staff 27 is inserted through the opening 7. Support legs 3 are rotated by pivot pins 9 such that the lower portions extend downwardly and outwardly to rest on flat surface 30. The upper portions of support legs 3 extend upwardly and inwardly to engage the tree trunk 27. Because the support legs 3 are pivotally attached, the base plate 1 will tilt from the horizontal plane and the support legs 3 will extend at different angles to permit the sharpened spikes 13 to engage the curved tree trunk 27 at varying heights and angles above the base plate 1 as dictated by the irregular shape of the trunk 27. The cams 21 are then rotated about pivot pins 23 to engage and hold in the opening 7 the lower, terminal end of the tree trunk 27, thus supporting the tree (not shown) in an upright position. The weight of the tree exerts a downward force on the lower portion of the curved trunk 27 forcing the sharpened spikes 13 to bite deeper into the tree trunk 27 and extend the lower portions of the support legs 3 outwardly thus tightly holding the tree and increasing the stability of the stand while in use. The lower portion of the tree trunk or staff 27 may extend through the base plate opening 7 into contact with the surface 30 upon which the stand 10 rests thereby providing a third support point for the tree or staff if desired.

Figure 4:
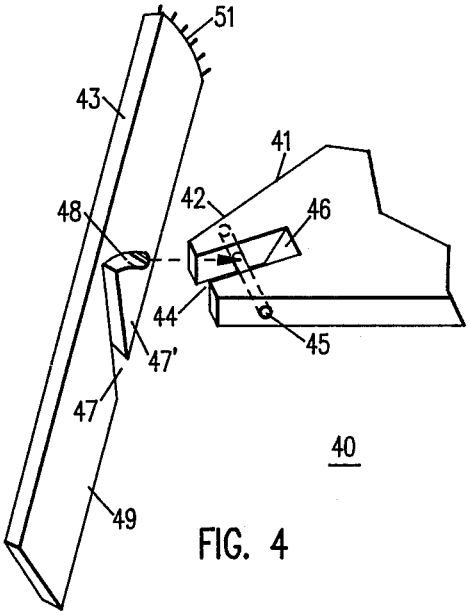
FIG. 4 is a perspective view illustrating a second preferred embodiment of the Christmas tree stand of FIG. 1.

Referring now also to FIG. 4, one corner portion 40 of a second preferred embodiment providing a disassemable Christmas tree stand is shown. The disassemable stand is generally similar to the stand 10 shown in FIGS. 1,2 and 3 described hereinabove, but having removable support legs 43 allowing the stand to be disassembled thereby requiring less space for storage and transportation when not in use. The base plate 41 has elongated support legs 43 pivotally and removable attached at each corner 42 (only one corner being shown in FIG. 4). Each support leg 43 is generally similar to support leg 3 (as shown in FIG. 1), but differing in that a slot 47 is formed in leg 43 opening on and extending at an acute angle 47' from the bottom edge 49 generally lengthwise towards the upper end 51. The slot 47 is terminated in a generally hook-shaped turn 48 back towards the bottom edge 49. Each corner 42 of the base plate 41 has a slot or bifurcation 44 for receiving the support legs 43. Pivot pin 45 extends horizontally through the slot 44 and is permanently fixed in position. To assemble the stand, support leg 43 is positioned in the slot 44 with the opening of slot 47 placed over pivot pin 45 and moved with a downward motion such that support leg 43 is held in slot 44 by the pivot pin 45 in hook-turn 48. As described hereinabove, when a cut tree or staff is inserted through the base plate opening and the support legs 43 have engaged the lower portion of the cut tree or staff, the weight of the cut tree or staff will tend to force the support legs 43 downwardly and outwardly thereby locking the support legs 43 in position on pivot pin 45. Upwardly sloping wall 46 prevents the support legs 43 from pivoting past a predetermined angle and insures that the support legs 43 will remain in a locked position.

Figure 5:
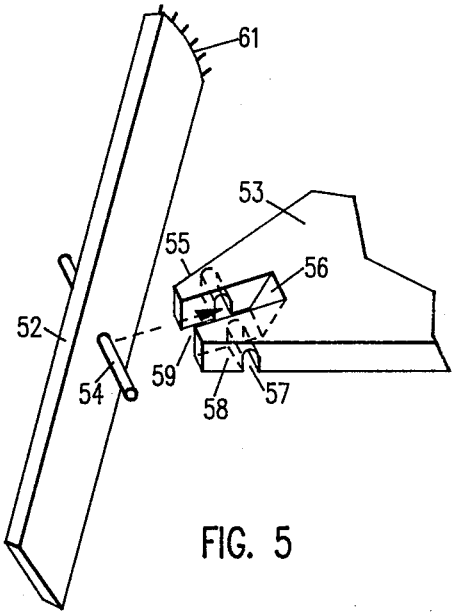
FIG. 5 is a perspective view illustrating an alternate implementation of the preferred embodiment of the Christmas tree stand shown in FIG. 4.

Referring now also to FIG. 5, a second implementation of the disassemable stand is shown. Each corner 55 of baseplate 53 (only one corner 55 of which is shown) has a slot or bifurcation 59 for receiving elongated support leg 52. At each corner 55 a slot or groove 57 is formed in the bottom of the base plate 53, extending across the corner 55 through the slot 59 at a right-angle to slot 59. Each support leg 52 is constructed generally as described hereinabove and has a pivot pin 54 fixedly attached extending crosswise through the support leg 52 and perpendicular to the major plane of the support leg 52. To assemble, each support leg 52 is positioned in slot 59 at each corner 55 such that pivot pin 54 is disposed in slot 57. When a cut tree or staff is inserted through the opening in the base plate, the support legs 52 are pivoted inwardly such that the upper ends 61 engage the lower portion of the cut tree or staff to support it in a vertical, upright position. The slots 57 may be formed at an acute angle 58 with respect to the bottom and the perimeter of the base plate 53 to ensure that the pivot pins 54 do not slip out of the slots 57. The weight of the cut tree or staff will tend to force the support legs downwardly and outwardly ensuring the support legs remain locked in position against the upwardly sloping wall 56 with the pivot pins 54 in slots 57.

While the invention has been described and illustrated in its preferred embodiment, it is to be understood that the invention is not to be limited to the precise details herein illustrated and described since the invention may be carried out in other ways falling within the scope of the invention.

We claim:

1. Articulated apparatus for holding and supporting an elongated member having an irregularly shaped lower portion, said articulated apparatus comprising:

a base plate oriented generally in the horizontal plane, said base plate having a generally circular opening therethrough for receiving and holding said lower portion of said elongated member;

a plurality of elongated support members pivotally attached to said base plate at points spaced equidistant about the perimeter of said base plate forming joints at said points for articulatably adjusting to said irregular shape of said elongated member;

each of said plurality of support members having an upper end and a lower end, said upper end including means for engaging said irregularly shaped lower portion of said elongated member at a position spaced upwardly from the terminal end of said elongated member and above said base plate; and a plurality of cam means pivotally attached to the lower surface of said base plate at points spaced equidistant about the perimeter of said opening, said plurality of cam means for engaging the portion of said elongated member extending through said opening and below said base plate holding and rigidly maintaining said elongated member in said opening thereby supporting said elongated member in an upright, vertical position.

2. Articulated apparatus as in claim 1 wherein said means for engaging said lower portion of said elongated member comprise a plurality of sharpened spikes protruding from said upper ends of said support members, said sharpened spikes for engaging and securely gripping said lower portion of said elongated member.

3. Articulated apparatus for holding and supporting a cut tree or the like, the lower portion of its trunk being irregularly shaped, said articulated apparatus comprising:

a generally triangularly-shaped base plate having three sides of substantially equal length and a generally circular opening therethrough, the center of said opening disposed substantially equidistant from each of said three sides, said opening for receiving the lower portion of the trunk of said cut tree;

three elongated support members pivotally attached to said base plate, each of said support members attached to a different one of the corners formed by said three sides of said base plate forming joints at said corners for articulatably adjusting to said irregularly shaped lower portion of said cut tree, each of said support members having an upper end and a lower end, said upper end extending upwardly and inwardly and said lower end extending downwardly and outwardly with respect to said base plate, each of said upper ends including means for engaging said irregularly shaped lower portion of said cut tree at a position above said base plate and spaced upwardly from the terminal end of said trunk when said lower portion is extending through said opening; and a plurality of cam means pivotally attached to the lower surface of said base plate at points spaced equidistant about the perimeter of said opening, said plurality of cam means for engaging the portion of said trunk extending through said opening below said base plate holding said trunk in said opening thereby supporting said cut tree in a vertical, upright position.

4. Articulated apparatus as in claim 3 wherein said means for engaging said irregularly shaped lower portion of said trunk comprise a plurality of sharpened spikes protruding from said upper ends of said support members, said sharpened spikes for engaging and securely gripping said irregularly shaped lower portion of said trunk.

5. Articulated apparatus for holding and supporting an elongated member in a vertical, generally upright position, said articulated apparatus comprising:

a base plate oriented generally in the horizontal plane, said base plate having an opening therethrough for receiving and holding a lower portion of said elongated member;

a plurality of elongated support members pivotally and removably attached to said base plate at points spaced about the perimeter of said base plate forming joints at said points for articulatably adjusting to the shape of said lower portion of said elongated member;

each of said plurality of support members having an upper end and a lower end, said upper end including means for engaging said lower portion of said elongated member at a position spaced upwardly from the terminal end of said lower portion of said elongated member and above said base plate when said lower portion is inserted through said opening; and a plurality of cam means pivotally attached to the lower surface of said base plate at points spaced equidistant about the perimeter of said opening, said plurality of cam means for engaging said portion of said elongated member extending through said opening below said base plate holding and rigidly maintaining said elongated member in said opening thereby supporting said elongated member in an upright and vertical position.

6. Articulated apparatus as in claim 5 wherein each of said plurality of elongated support members include pivot means for pivotally and removably attaching each elongated support member at said points of said base plate.

7. Articulated apparatus as in claim 6 wherein:

said pivot means comprise a pivot pin extending crosswise through said support member perpendicular to a major plane of said support member; and said base plate includes groove at each said point formed in the lower surface of said base plate for receiving and retaining said pivot pin when said support means is pivotally attached to said base plate.

8. Articulated apparatus as in claim 7 wherein said groove formed in the bottom surface of said base plate is oriented at an acute angle with respect to the bottom surface of said base plate and said perimeter of said base plate.

9. Articulated apparatus as in claim 5 wherein:

said base plate has a vertically oriented first slot formed at each of said points, said first slot extending from said perimeter inwardly towards said opening, said first slot for receiving said elongated support member;

a pivot pin oriented fixedly attached to said base plate extending across said first slot; and said elongated support member having a second slot formed therein, said second lot extending from a bottom edge of a generally lengthwise towards said upper end along said elongated support member, said second slot oriented at an acute angle with respect to said bottom edge, said second slot for receiving said pivot pin when said elongated support member is pivotally attached to said base plate.

10. Articulated apparatus as in claim 9 wherein said second slot is terminated in a hook-shaped turn towards said bottom edge, said hook-shaped termination for receiving said pivot pin when said elongated support member is pivotally attached to said base plate.

11. Articulated apparatus as in claim 5 wherein said means for engaging said lower portion of said elongated member comprises a plurality of sharpened spikes protruding from said upper ends of said elongated support members, said sharpened spikes for engaging and securely gripping said lower portion of said elongated member.

* * * * *